US005601290A

United States Patent [19]

Yiu

[11] Patent Number: 5,601,290

[45] Date of Patent: Feb. 11, 1997

[54] DOUBLE BULLSEYE FOR DART GAME

[76] Inventor: Chih-Hao Yiu, Fl. 7-1, No. 30, Lin Sen Road, Taichung, Taiwan

[21] Appl. No.: 529,565

[22] Filed: Sep. 18, 1995

[51] Int. Cl.[6] ..... F41J 3/00

[52] U.S. Cl. ..... 273/376

[58] Field of Search ..... 273/376, 403, 273/408, 374, 404

[56] References Cited

U.S. PATENT DOCUMENTS

| | | | |
|---|---|---|---|
| 4,057,251 | 11/1977 | Jones et al. | 273/408 X |
| 4,586,716 | 5/1986 | Brejcha et al. | 273/376 |
| 5,116,063 | 5/1992 | Harlan et al. | 273/376 |
| 5,193,817 | 3/1993 | Pan | 273/376 |
| 5,417,437 | 5/1995 | Coppard et al. | 273/403 |
| 5,482,291 | 1/1966 | Houriet, Jr. et al. | 273/376 |

*Primary Examiner*—William H. Grieb
*Attorney, Agent, or Firm*—Charles E. Baxley, Esq.

[57] ABSTRACT

A double bullseye for a dart game is slidably engaged in the dart game for engaging with a number of switch points. The double bullseye includes an outer bullseye and an inner bullseye slidably engaged in the outer bullseye. A cap is secured to the outer bullseye for limiting the sliding movement of the inner bullseye relative to the outer bullseye. The cap includes one or more projections for engaging with the switch points when the cap is inner moved by the outer bullseye. The inner bullseye includes one or more leg extended through the cap for engaging with the switch points. The leg is shorter than the projection so as to be prevented from engaging with the switch points when the outer bullseye is shot by a dart.

2 Claims, 8 Drawing Sheets

DOUBLE BULLSEYE FOR DART GAME

BACKGROUND OF THE INVENTION

1. Field of the Invention

The present invention relates to a dart game, and more particularly to a double bullseye for the dart game.

2. Description of the Prior Art

Dart games have become more and more popular and each comprises a number of scoring areas each having a slidable target segment engaged therein. At the beginning, the center portion of the target board includes a single bullseye only. However, after years of use, double bullseye has been developed and used in the dart boards. For example, U.S. Pat. No. 4,586,716 to Brejcha et al. discloses a double bullseye including an inner bullseye slidably engaged in an outer bullseye. The inner bullseye includes an annular shoulder formed therein for engaging with the corresponding annular shoulder of the outer bullseye so as to prevent the inner bullseye from disengaging from the outer bullseye. However, the inner bullseye may also be actuated by the outer bullseye when the dart is shot at the outer bullseye, such that error score may occur.

U.S. Pat. No. 5,116,063 to Harlen et al. also discloses a double bullseye. U.S. Pat. No. 5,193,817 to Pan discloses a dart game including a double bullseye having a rather complicated configuration. In addition, in all of the prior art, a ring is provided between the inner and outer bullseye for deflecting darts into the scoring segment. However, when the dart is shot at the ring with a slope, the dart which is supposed to be shot at the inner bullseye may be deflected by the ring to engage with the outer bullseye. Similarly, the dart which is supposed to be shot at the outer bullseye may be deflected by the ring to engage with the inner bullseye. This is unfair.

The present invention has arisen to mitigate and/or obviate the afore-described disadvantages of the conventional double bullseye for dart games.

SUMMARY OF THE INVENTION

The primary objective of the present invention is to provide a double bullseye in which the inner and outer bullseyes are clearly separated by an annular slit and have no ring provided therebetween such that the darts may be precisely shot at the definite bullseye.

The other objective of the present invention is to provide a double bullseye which includes a greatly simplified configuration.

In accordance with one aspect of the invention, there is provided a double bullseye for a dart game. The double bullseye comprises an outer bullseye including a front portion having a plurality of openings formed therein for receiving a dart therein and including a rear portion, and including a center portion having a cylindrical wall formed therein, the cylindrical wall including a rear cap formed therein, the rear cap including at least one orifice formed therein, the outer bullseye including at least one limb extended rearward beyond the rear portion of the outer bullseye, an inner bullseye slidably engaged in the cylindrical wall and including a front portion having a plurality of holes for receiving the dart therein and including a rear portion having at least one leg extended therefrom for slidably engaging with the orifice of the rear cap of the cylindrical wall and for engaging with the switch points, the leg being allowed to extend outward beyond the rear cap and beyond the limbs of the outer bullseye for engaging with the switch points, and stop means secured to the inner bullseye and engaged with the rear cap so as to prevent the inner bullseye from disengaging from the outer bullseye, the leg being shorter than the limb when the front portion of the inner bullseye is flush with the front portion of the outer bullseye such that the leg is prevented from engaging with the switch points when the limb is forced to engage with the switch points by the outer bullseye, and the leg being moved rearward beyond the limb in order to engage with the switch points when the bullseye is moved inward of the cylindrical wall.

In accordance with the other aspect of the invention, there is provided a double bullseye for a dart game and for being slidably engaged in the dart game for engaging with switch points. The double bullseye comprises an outer bullseye including a front portion having a plurality of holes formed therein for receiving a dart therein and including a rear portion, and including a center portion having a cylindrical wall formed therein, an inner bullseye slidably engaged in the cylindrical wall and including a front portion having a plurality of holes formed therein for receiving the dart therein and including a rear portion having at least one leg extended therefrom for engaging with the switch points, a cap secured to the rear portion of the outer bullseye and including at least one projection extended therefrom for engaging with the switch points, the cap including at least one orifice formed therein for slidably engaging with the leg of the inner bullseye so as to allow the leg to extend outward beyond the cap and so as to allow the leg to engage with the switch points, and stop means secured to the inner bullseye and engaged with the cap so as to prevent the inner bullseye from disengaging from the outer bullseye. The leg is shorter than that of the projection when the front portion of the inner bullseye is flush with the front portion of the outer bullseye such that the leg is prevented from engaging with the switch points when the projections are forced to engage with the switch points by the outer bullseye.

In accordance with a further aspect of the invention, there is provided a double bullseye for a dart game. The double bullseye comprises an outer bullseye including a front portion having a plurality of openings formed therein for receiving a dart therein and including a rear portion, and including a center portion having an inner peripheral surface formed therein and arranged in tangent with the openings, the openings including a front portion having a tapered surface formed therein for receiving the dart therein, an inner bullseye slidably engaged in the center portion of the outer bullseye and including a front portion having a plurality of holes for receiving the dart therein and including a rear portion having at least one leg extended therefrom for engaging with the switch points, the inner bullseye including an outer peripheral surface arranged in tangent with the holes, the holes, the holes including a front portion having a tapered surface formed therein for receiving the dart therein, and means for preventing the inner bullseye from disengaging from the outer bullseye.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
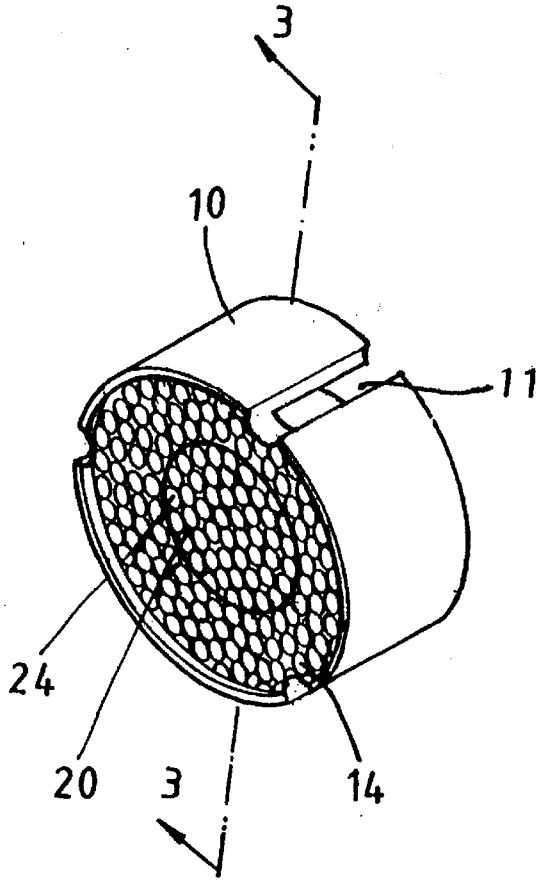
FIG. 1 is a perspective view of a double bullseye in accordance with the present invention.
Figure 2:
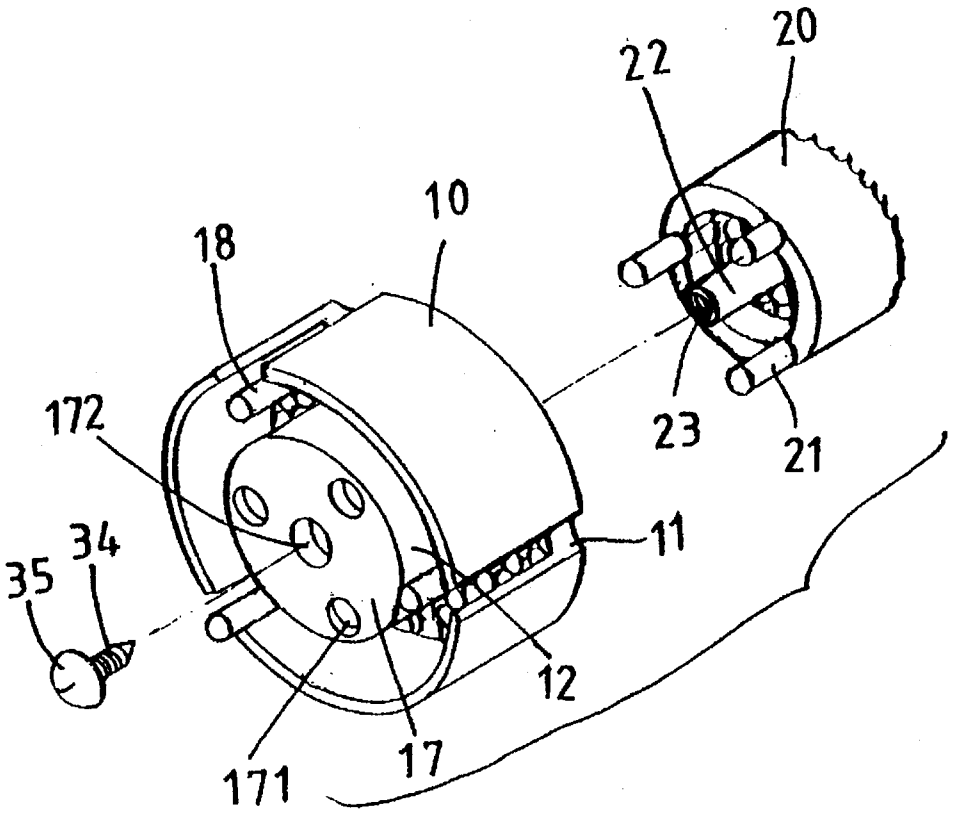
FIG. 2 is a rear exploded view of the double bullseye.
Figure 3:
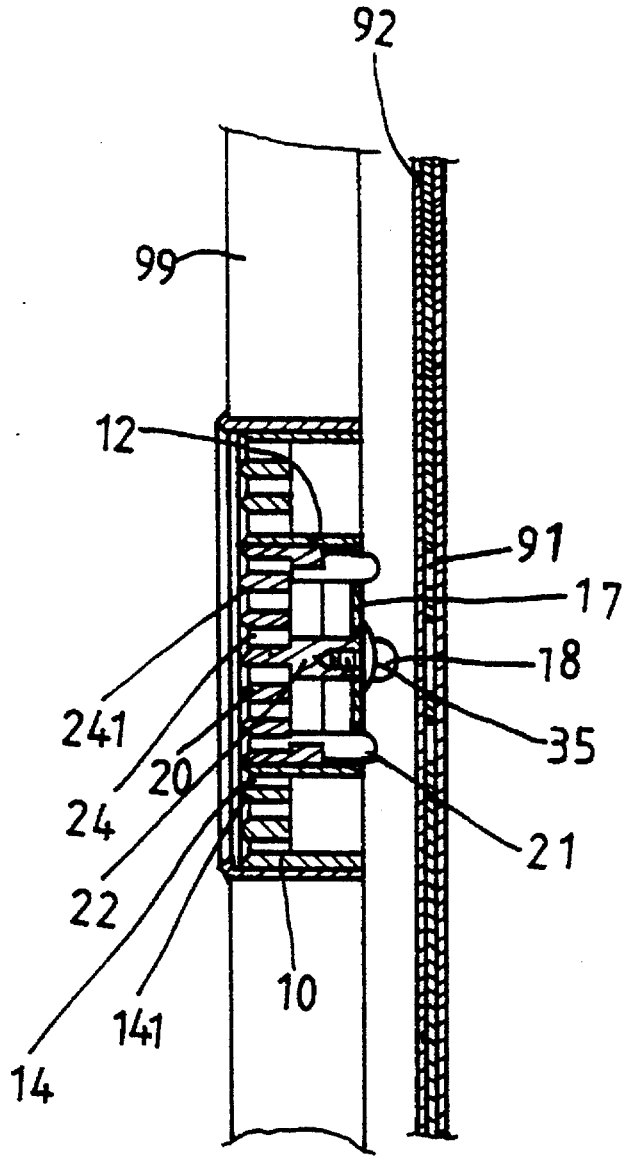
FIGS. 3, 4, 5 are cross sectional views taken along lines 3—3 of FIG. 1, illustrating the application of the double bullseye.
Figure 4:
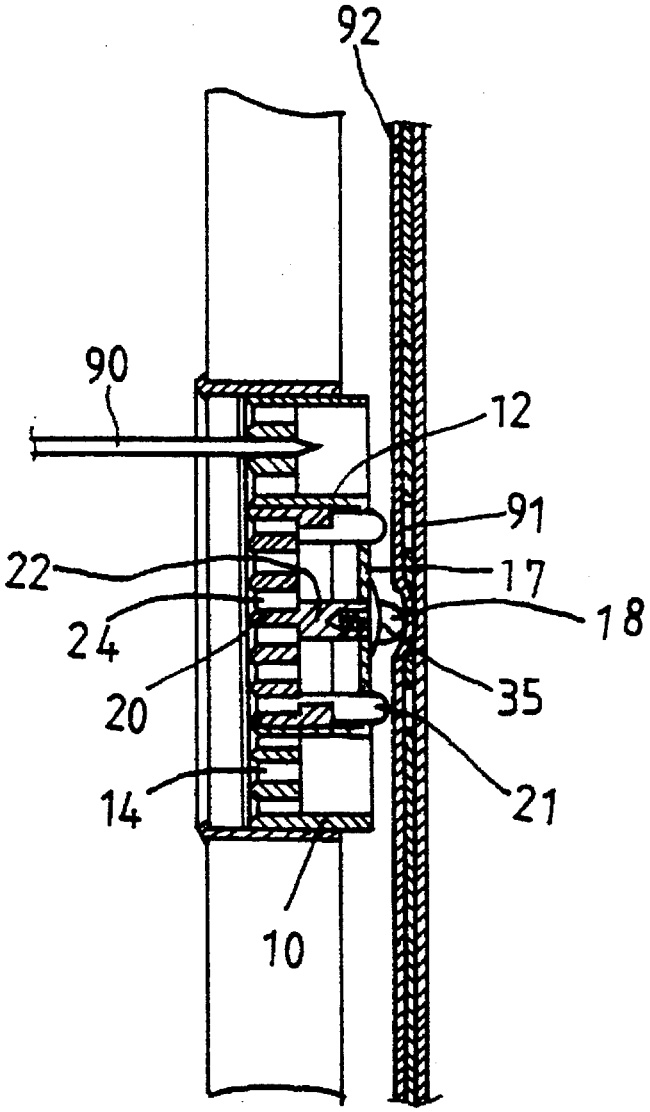
Figure 5:
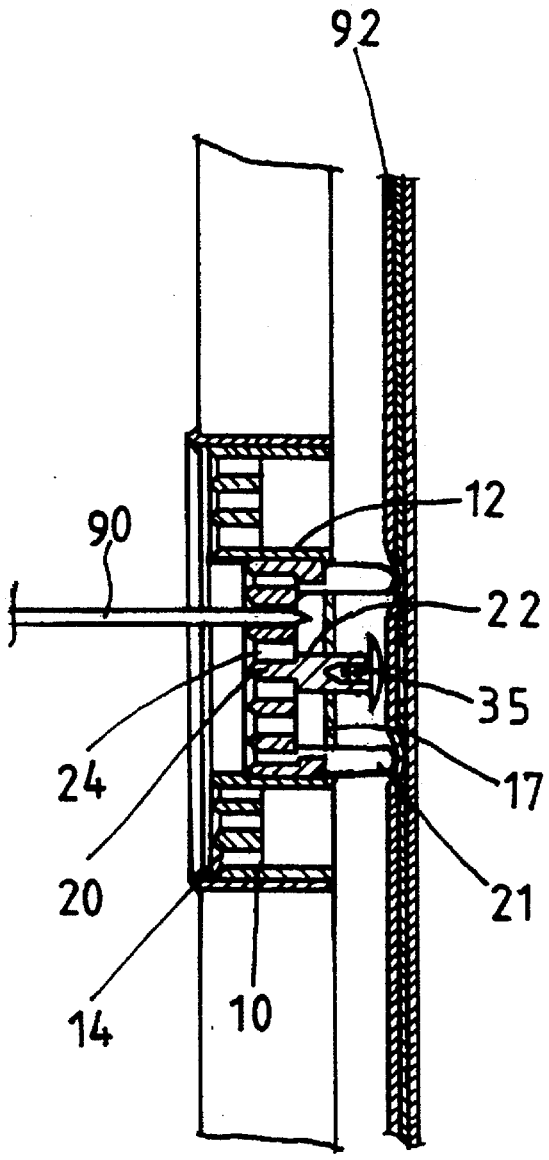

Referring to FIGS. 1 to 4, a double bullseye in accordance with the present invention comprises an outer bullseye 10 including a number of guiding slots 11 longitudinally formed in the outer peripheral portion for engaging with the corresponding guiding ribs of the dart board 99 so as to guide the outer bullseye 10 to slide in the longitudinal direction and so as to prevent the outer bullseye 10 from rotating relative to the dart board. The outer bullseye 10 includes a cylindrical wall 12 extended therein and includes three limbs 18 extended rearward beyond the outer bullseye 10 (FIGS. 3 to 5). The outer bullseye 10 includes a number of openings 14 formed in the front portion for receiving the darts 90 (FIGS. 4 and 5). The cylindrical wall 12 includes a rear cap 17 having three orifices 171 and an aperture 172 formed therein.

An inner bullseye 20 is slidably engaged in the cylindrical wall 12 and includes one or more legs 21 extended therefrom for slidably engaging with the orifices 171 of the rear cap 17 and includes a pole 22 having an inner thread 23 formed therein for engaging with a screw 34 with is engaged through the aperture 172 of the rear cap 17. The screw 34 includes an enlarged head 35 for engaging with the rear cap 17 so as to limit the sliding movement of the inner bullseye 20 relative to the cylindrical wall 12 of the outer bullseye 10 and so as to prevent the inner bullseye 20 from disengaging from the outer bullseye 10. The inner bullseye 20 also includes a number of holes 24 formed in the front portion for receiving the darts 90.

As best shown in FIG. 3, the legs 21 of the inner bullseye 20 and the limbs 18 of the outer bullseye 10 may both be forced to engage with a number of switch points 91 which are protected by a damper sheet material 92. The limbs 18 of the outer bullseye 10 may be forced to engage with the switch points 91 when a dart 90 is shot at the outer bullseye 10 as shown in FIG. 4. However, it is to be noted that the legs 21 of the inner bullseye 20 are slightly short as compared with the limbs 18 of the outer bullseye 10 when the front surfaces of the inner and outer bullseyes 10, 20 are flush with each other, best shown in FIGS. 3 and 4, such that the legs 21 of the inner bullseye 20 will not be forced to engage with the switch points 91 when the outer bullseye 10 is shot by the dart 90.

As shown in FIG. 5, the legs 21 of the inner bullseye 20 are slidably engaged in the orifice 171 such that the legs 21 of the inner bullseye 20 can be forced to engage with the switch points 91 when the inner bullseye 20 is shot by a dart 90. However, at this moment, the outer bullseye 10 is not actuated such that the limbs 18 of the outer bullseye 10 will not be caused to actuate the switch points 91.

Figure 6:
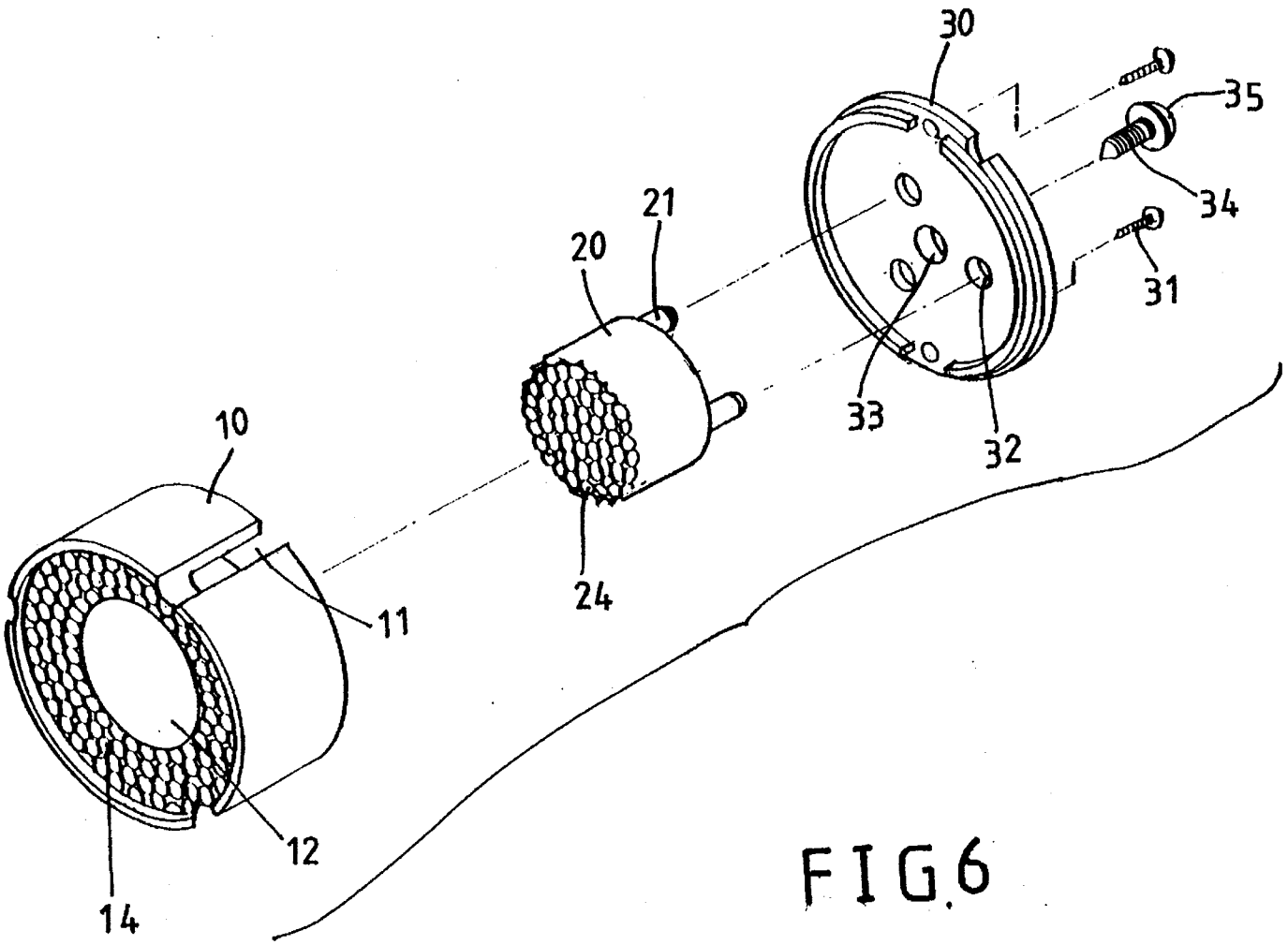
FIG. 6 is a front exploded view of the other application of the double bullseye.
Figure 7:
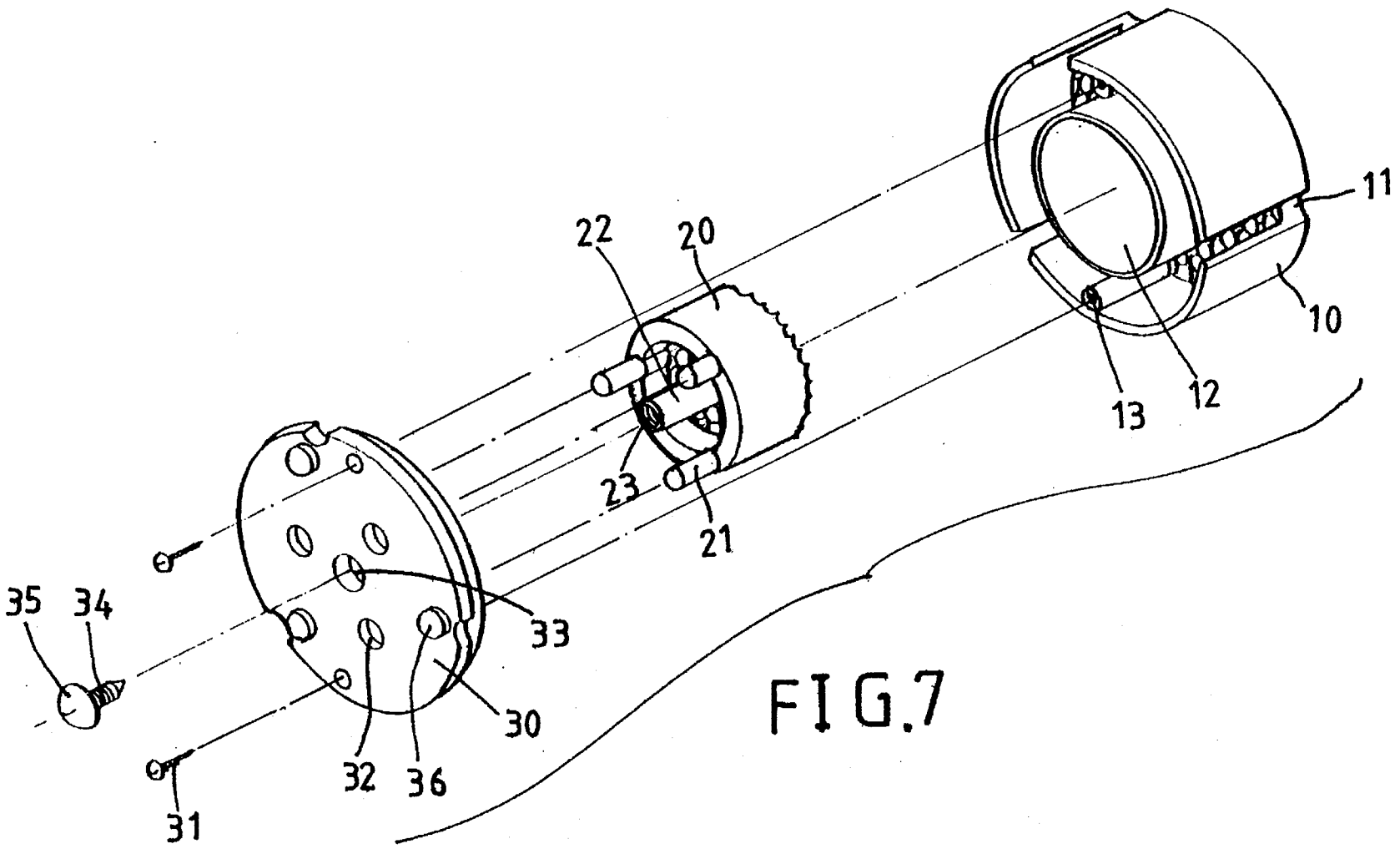
FIG. 7 is a rear exploded view of the double bullseye as shown in FIG. 6.
Figure 8:
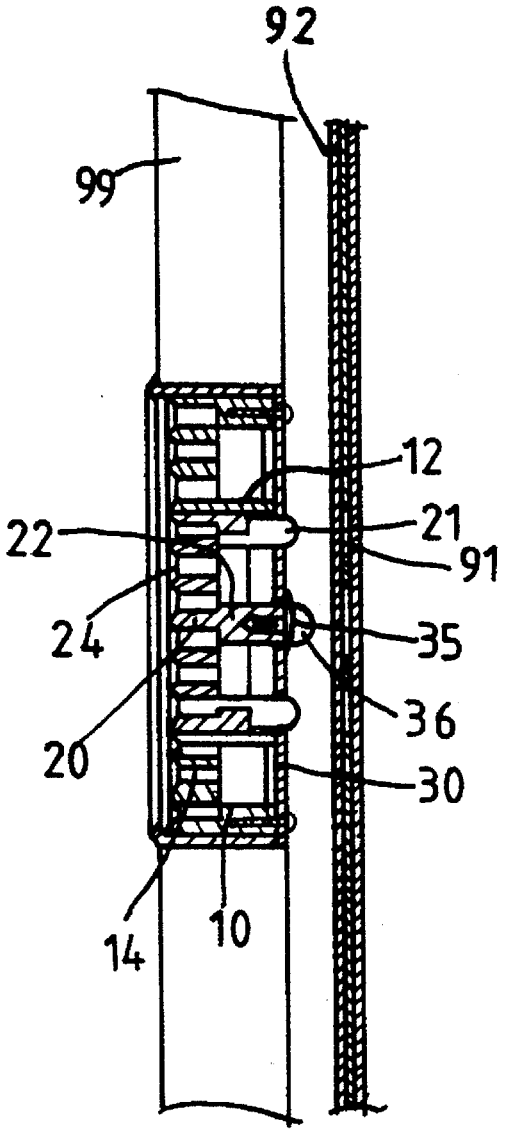
FIG. 8 is a cross sectional view illustrating the application of the double bullseye as shown in FIGS. 6 and 7.

Referring next to FIGS. 6 to 8, alternatively, a cap 30 is secured to the rear portion of the outer bullseye 10 by a number of screws 31 which are engaged with the posts 13 extended from the outer bullseye 10. The cap 30 also includes a number of orifice 32 and an aperture 33 for engaging with the legs 21 of the inner bullseye 20 and for engaging with the pole 22 respectively. The screw 34 also includes an enlarged head 35 for engaging with the cap 30 so as to limit the sliding movement of the inner bullseye 20 in the outer bullseye 10 and so as to prevent the inner bullseye from disengaging from the outer bullseye. The cap 30 includes three projections 36 extended therefrom. The cap 30 is solidly secured to the outer bullseye 10 such that the projections 36 of the cap 30 may be forced to engage with the switch points 91 when a dart 90 is shot at the outer bullseye 10. The legs 21 of the inner bullseye 20 are slightly short as compared with the projections 36 of the cap 30 when the front surfaces of the inner and outer bullseyes 10, 20 are flush with each other, best shown in FIG. 8, such that the legs 21 of the inner bullseye 20 will not be forced to engage with the switch points 91 when the outer bullseye 10 is shot by the dart 90. The legs 21 of the inner bullseye 20 can be forced to engage with the switch points 91 when the inner bullseye 20 is shot by a dart 90. However, similarly, at this moment, the outer bullseye 10 is not actuated such that the projections 36 of the cap 30 will not actuate the switch points 91.

As shown in FIGS. 1, 3 to 6 and 8, the outer bullseye 10 includes an inner peripheral surface having a number of openings 14 arranged in tangent therewith; and the inner bullseye 20 inccludes an outer peripheral surface having a number of holes 24 arranged in tangent therewith such that no ring element is formed between the inner and outer bullseyes 10, 20. The holes 24 and the openings 14 each includes a tapered surface 141, 241 formed in the front portion such that the darts which are supposed to be shot at either the inner or the outer bullseye will be precisely shot at the inner or the outer bullseye and will not be shot at the bullseye which is not supposed to be shot.

Accordingly, the double bullseye in accordance with the present invention includes an inner and an outer bullseyes which are clearly separated by an annular slit and which have no ring provided therebetween such that the darts may be precisely shot at the definite bullseye. The inner bullseye is slidable between the outer bullseye and the cap and will not be forced to engage with the switch points when the outer bullseye is shot by the darts.

Although this invention has been described with a certain degree of particularity, it is to be understood that the present disclosure has been made by way of example only and that numerous changes in the detailed construction and the combination and arrangement of parts may resorted to without departing from the spirit and scope of the invention as hereinafter claimed.

I claim:

1. A double bullseye for a dart game being slidably engaged in the dart game for engaging with a plurality of switch points, said double bullseye comprising:

an outer bullseye including a front portion having a plurality of openings formed therein for receiving a dart therein and including rear portion, and including a center portion having cylindrical wall formed therein, said cylindrical wall, including a rear cap formed therein, said rear cap including at least one orifice formed therein, said outer bullseye including at least one limb extended rearward beyond said rear portion of said outer bullseye, an inner bullseye slidably engaged in said cylindrical wall and including a front portion having a plurality of holes for receiving the dart therein and including a rear portion having at least one leg extended therefrom for slidably engaging with said orifice of said rear cap of said cylindrical wall and for engaging with the switch points, said leg being allowed to extend outward beyond said rear cap and beyond said limbs of said outer bullseye for engaging with the switch points, and stop means secured to said inner bullseye and engaged with said rear cap so as to prevent said inner bullseye from disengaging from said outer bullseye, said leg being shorter than said limb when said front portion of said bullseye is flush with said front portion of said outer bullseye such that said leg is prevented from engaging with said switch points when said limb is forced to engage with the switch points by the outer bullseye, and said leg being moved rearward beyond said limb in order to engage with the switch points when said inner bullseye is moved inward of the cylindrical wall.

2. A double bullseye for a dart game being slidably engaged in the dart game for engaging with a plurality of switch points, said double bullseye comprising:

an outer bullseye including a front portion having a plurality of openings formed therein for receiving a dart therein and including a rear portion, and including a center portion having a cylindrical wall formed therein, an inner bullseye slidably engaged in said cylindrical wall and including a front portion having a plurality of holes for receiving the dart therein and including a rear portion having at least one leg extended therefrom for engaging with the switch points, a cap secured to said rear portion of said outer bullseye and including at least one projection extended therefrom for engaging with the switch points, said cap including at least one orifice formed therein for slidably engaging with said leg of said inner bullseye so as to allow said leg to extend outward beyond said cap and so as to allow said leg to engage with the switch points, and stop means secured to said inner bullseye and engaged with said cap so as to prevent said inner bullseye from disengaging from said outer bullseye, said leg being shorter than said projection when said front portion of said inner bullseye is flush with said front portion of said outer bullseye such that said leg is prevented from engaging with said switch points when said projections are forced to engage with the switch points by said outer bullseye, and said leg being moved rearward beyond said projection in order to engage with the switch points when said inner bullseye is moved inward of the cylindrical wall.

* * * * *